US006182910B1

(12) United States Patent
Huen

(10) Patent No.: US 6,182,910 B1
(45) Date of Patent: Feb. 6, 2001

(54) SHOWER UNIT

(76) Inventor: Raico Hing Wah Huen, Unit 1-4, 23rd Floor, New Trend Center, 704 Prince Edward Road East, San Po Kong, Kowloon (HK)

( * ) Notice: Under 35 U.S.C. 154(b), the term of this patent shall be extended for 0 days.

(21) Appl. No.: 09/571,931

(22) Filed: May 16, 2000

(51) Int. Cl.[7] ..... B05B 17/00; A63F 9/00

(52) U.S. Cl. ..... 239/289; 263/139; 473/16

(58) Field of Search ..... 239/289; 463/16, 463/17, 22, 30, 31, 46–48; 273/138.1, 139; D21/370

(56) References Cited

U.S. PATENT DOCUMENTS 4,674,687 * 6/1987 Smith et al. ..... 239/525

* cited by examiner

*Primary Examiner*—Lesley D. Morris
(74) *Attorney, Agent, or Firm*—Leydig, Voit & Mayer, Ltd.

(57) ABSTRACT

A sprinkler shower has a game of chance machine mounted in a shower unit to display, at random, different portions of the periphery of rotatable cylinders. The cylinders are driven by a spring that is wound during use of the shower and unwinds, to rotate the cylinders, when water flowing through the shower unit is turned of.

5 Claims, 4 Drawing Sheets

SHOWER UNIT

BACKGROUND OF THE INVENTION

1. Field of the Invention

The invention relates to a shower unit.

2. Description of Prior Art

The invention relates more particularly to a shower unit have a generally circular apertured shower sprinkler outlet.

SUMMARY OF THE INVENTION

It is an object of the invention to provide a novelty shower unit to make showering more fun.

According to the invention there is provided a sprinkler shower unit incorporating a game of chance machine, the chance machine comprising a plurality of cylinders arranged side by side and rotatable about a common axis, each cylinder having a number of visual displays displaced around its peripheral surface, including a window in an exposed surface of the shower unit through which a selected portions of the periphery of each cylinder can be viewed, in which the chance machine includes a mechanical energy storage means that is charged by normal flow of water through the shower unit during use, and a mechanical drive mechanism arranged to apply stored energy to rotate the cylinders and so that they come to rest to provide different combinations of the visual displays located in the window from time to time during use of the shower.

The sprinkler shower unit may include means to release stored energy to the cylinders whenever flow of water through the shower unit ceases.

The stored energy means preferably comprises a coiled spring that is wound up by flow of water through the shower unit.

The sprinkler shower unit may include a water impeller wheel and a biassed dog clutch connected between the impeller wheel and the coil spring, including a pressure plate arranged to engage the clutch when water pressure in the shower unit is increased by flow of water therethrough.

The sprinkler shower unit may include an axially slidable drive shaft on the common axis to support the cylinders, including a separate clutch for connecting each cylinder to the drive shaft arranged to transfer stored energy of the coil spring to rotate the cylinders, including biassing means to slide the shaft into a position such that the clutches are normally disengaged, the arrangement being such as to allow the stored energy to rotate the cylinders via the separate clutches for limited periods of time whenever the spring unwinds.

BRIEF DESCRIPTION OF THE DRAWINGS

A sprinkler shower unit according to the invention will now be described by way of example with reference to the accompanying drawings in which.

DESCRIPTION OF THE PREFERRED EMBODIMENT

Figure 1:
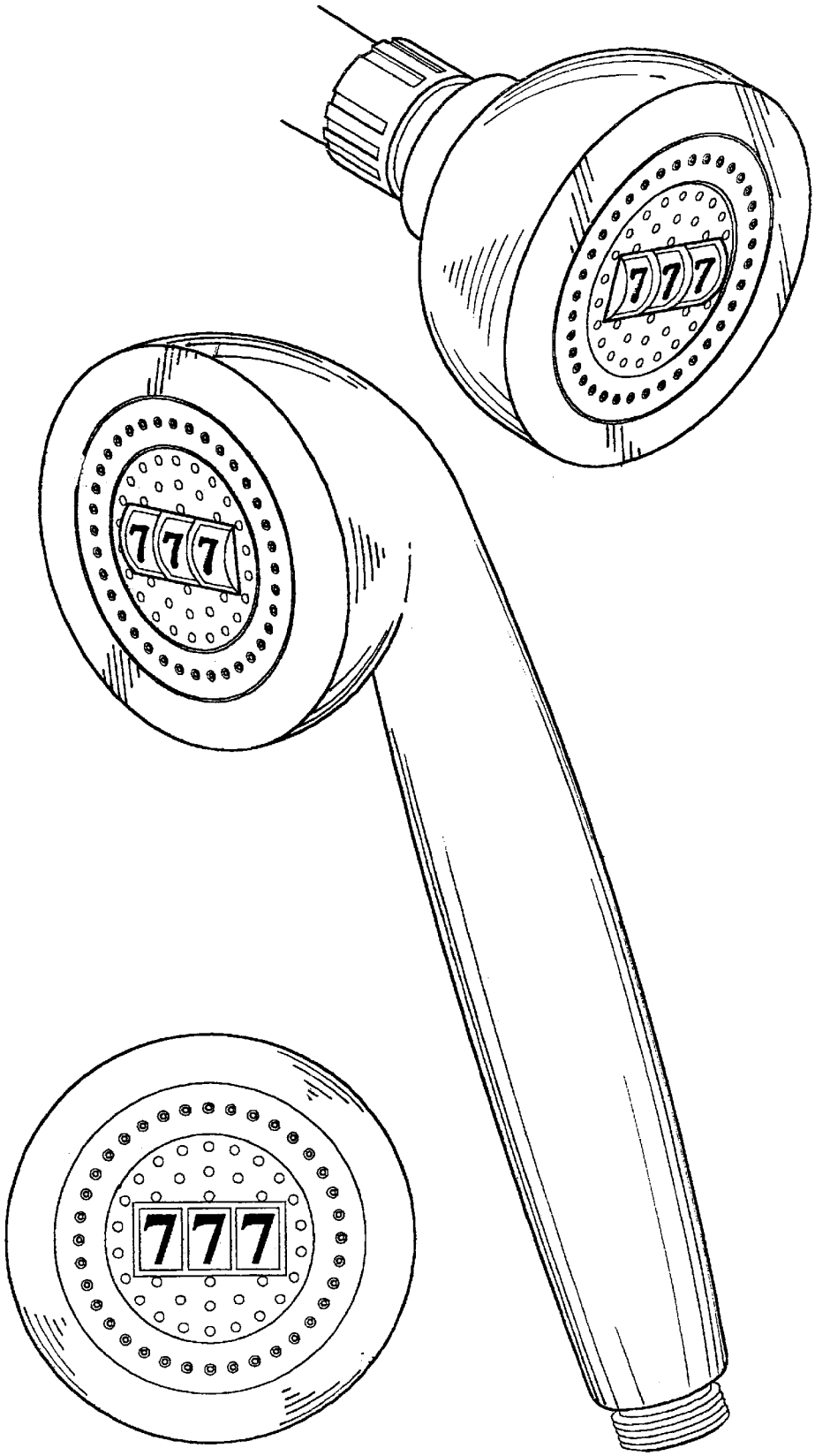
FIG. 1 is an isometric front view of the shower unit.

Referring to the drawings, in FIG. 1 the sprinkler shower unit 10 has a plurality of sprinkler apertures surrounding a central window 11 through which peripheral portions of three cylinders 12, 13 and 14 are visible. When the shower is used the cylinders 12 to 14 are rotated to display different combinations of symbols or numbers, in a fashion familiar of game machines of this type. As a result, at the end of each showering session when the water is turned OFF, the cylinders are automatically rotated and come to rest to display a different random combination of symbols or numbers in the window 11. This makes using a shower more interesting and adds some fun.

Figure 2:
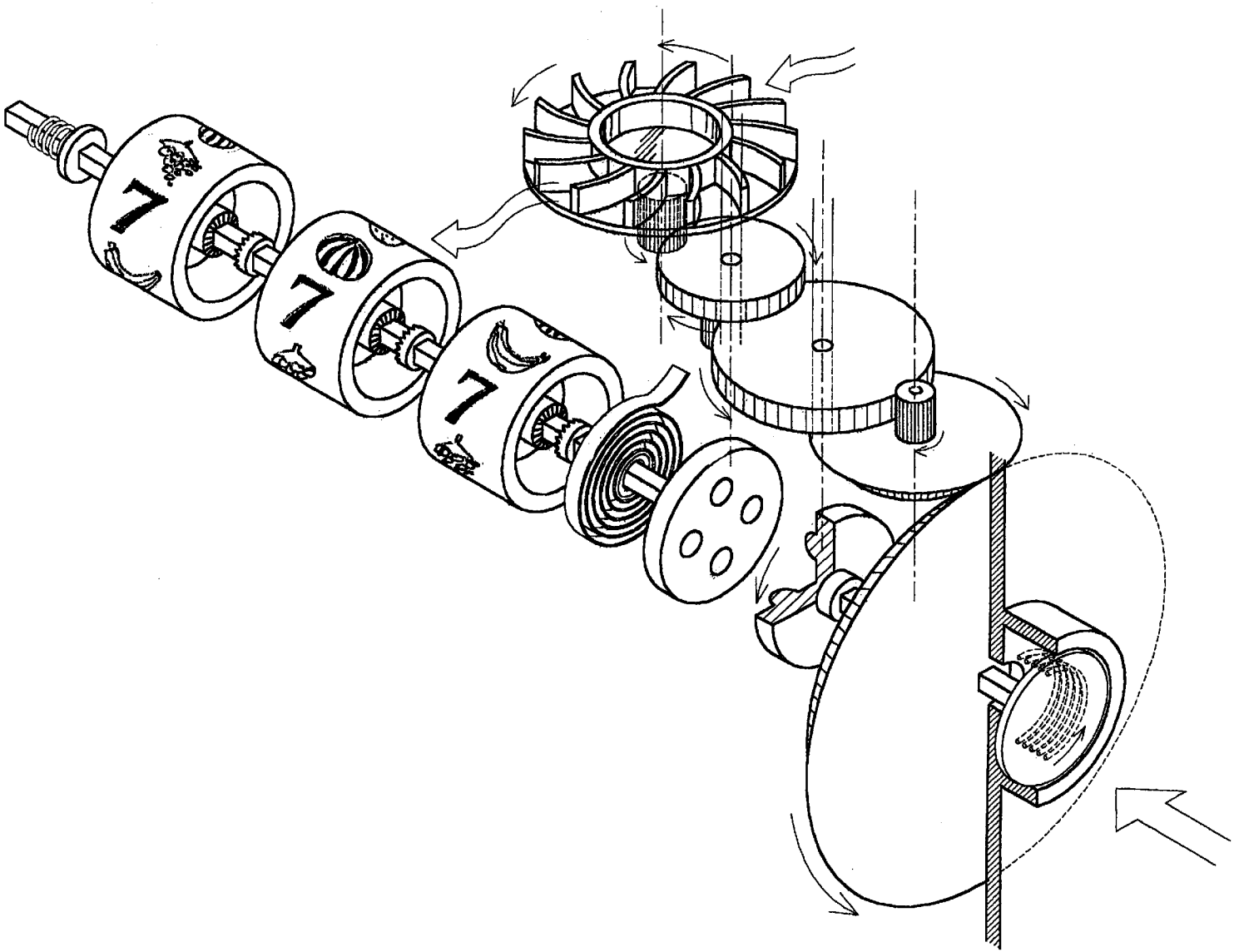
FIG. 2 is a partially sectioned isometric view of a game of chance machine for incorporation in the shower unit.

In FIG. 2, the mechanism of the chance machine is illustrated and includes the three cylinders 12, 13 and 14. The cylinders are mounted side by side on a common axis of a drive shaft 15. At one end of the drive shaft there is a dog clutch plate 16. A coil spring 17 is anchored to the drive shaft and is wound in use to provide a source of mechanical stored energy for rotating the cylinders 12 to 14, as will be explained below.

A water impeller 18 is connected via a gear train 19 to a shaft 20 on which a clutch plate 21 is fixed. The Figure also shows biassing springs 22 and 23 and separate clutches 24, 25 and 26 for the cylinders 12, 13 and 14, respectively.

Figure 3:
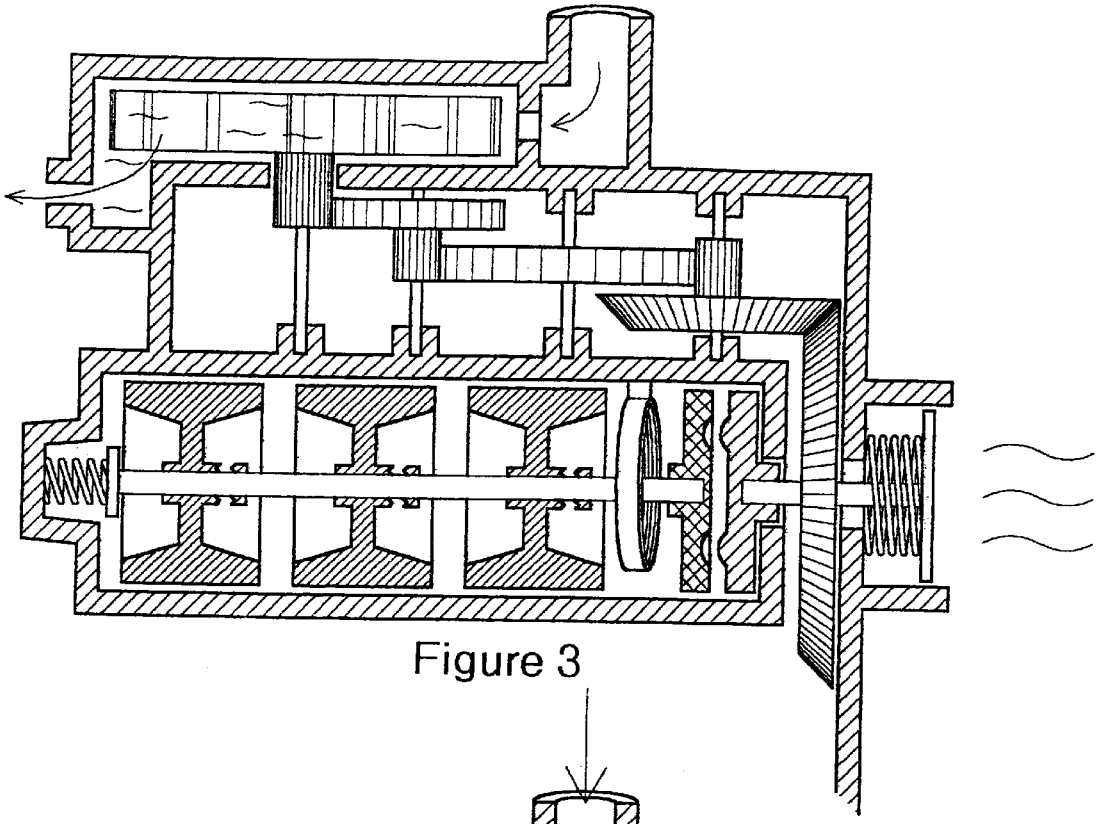
FIGS. 3, 4, 5 and 6 are front sectional elevations of the chance machine in different configurations.
Figure 4:
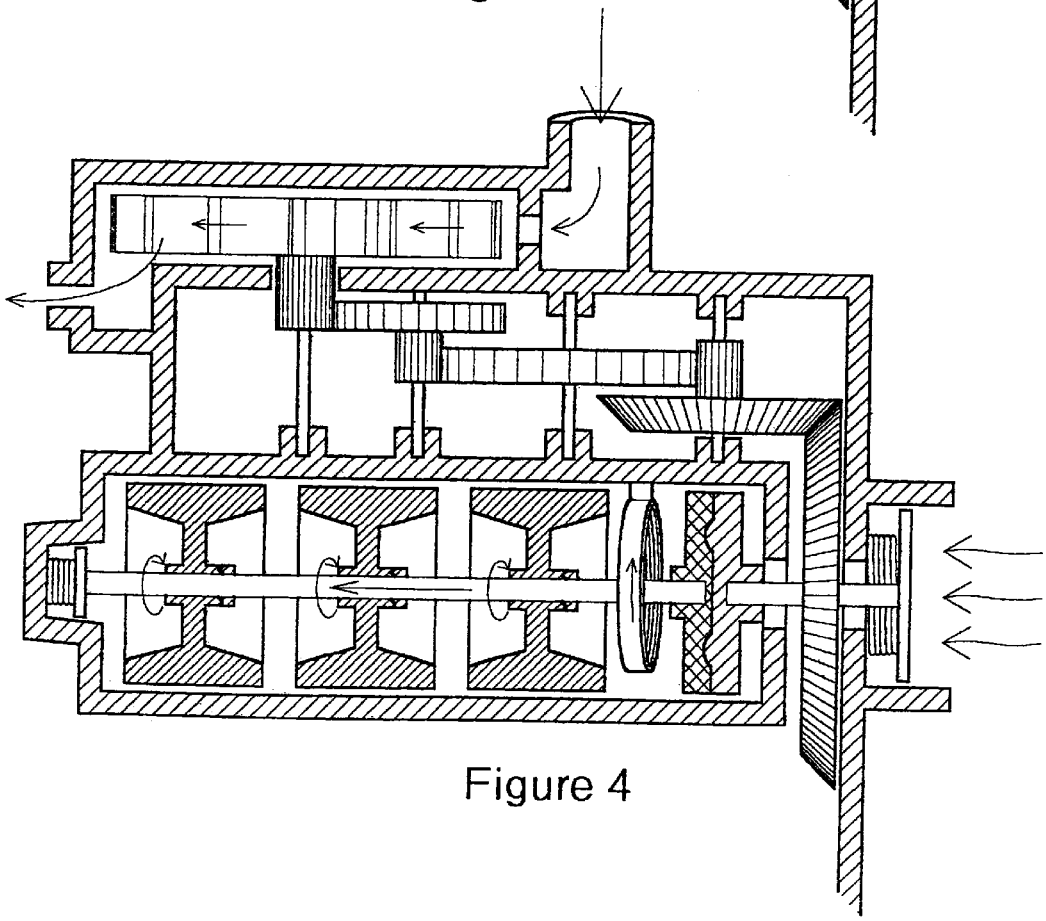
Figure 6:
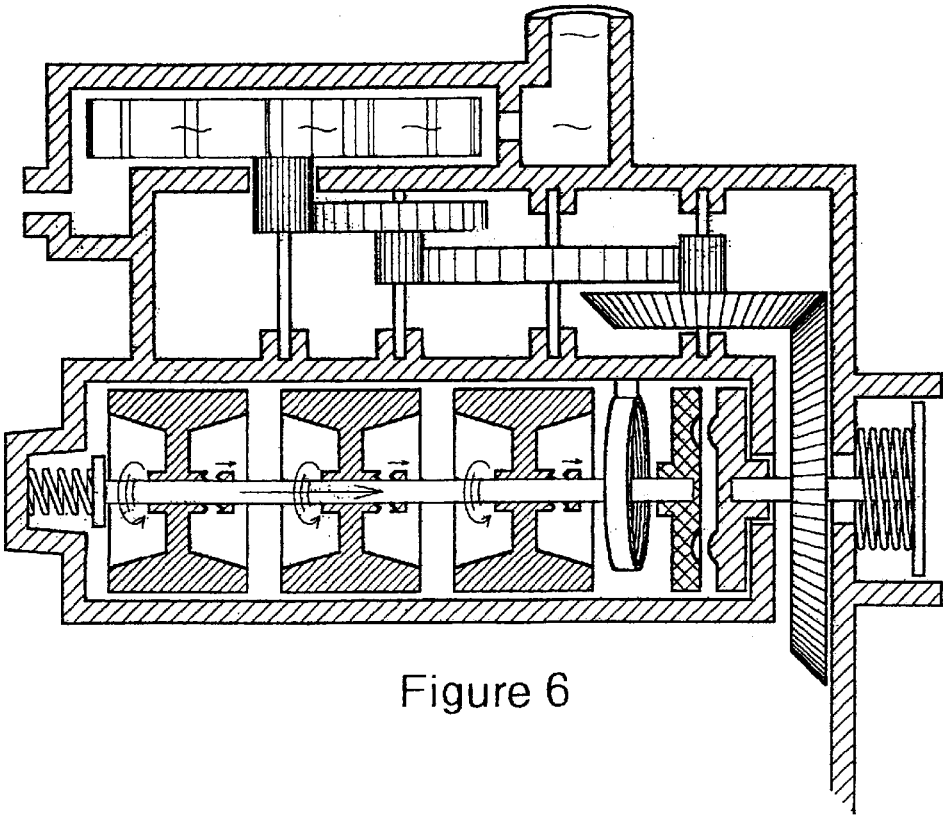

Referring to FIGS. 3, 4, and 6, the operation of the chance machine will be described beginning with FIG. 3. Water flows through a passage 27 when water is supplied to flow through the shower unit 10. The flow of water also in the passage 27 turns the impeller 18 to rotate the shaft 20.

At the same time, water pressure in the shower unit acts on a pressure plate 28 to compress the spring 22 and urge the plates 16 and 21 so the dog clutch is engaged. The drive shaft 15 is moved to the left (as shown in FIG. 4), compressing the spring 23. For so long as the water flows through the shower thereafter the coil spring is wound and the cylinders 12, 13 and 14 are rotated slowly by the force applied by the impeller 18, because the clutches 24, 25 and 26 are "in mesh". If the spring 23 winds completely, the illustrated dog clutch, formed by the plates 16 and 21, can slip, as will be apparent from the Figures and well understood by persons in the art.

Figure 5:
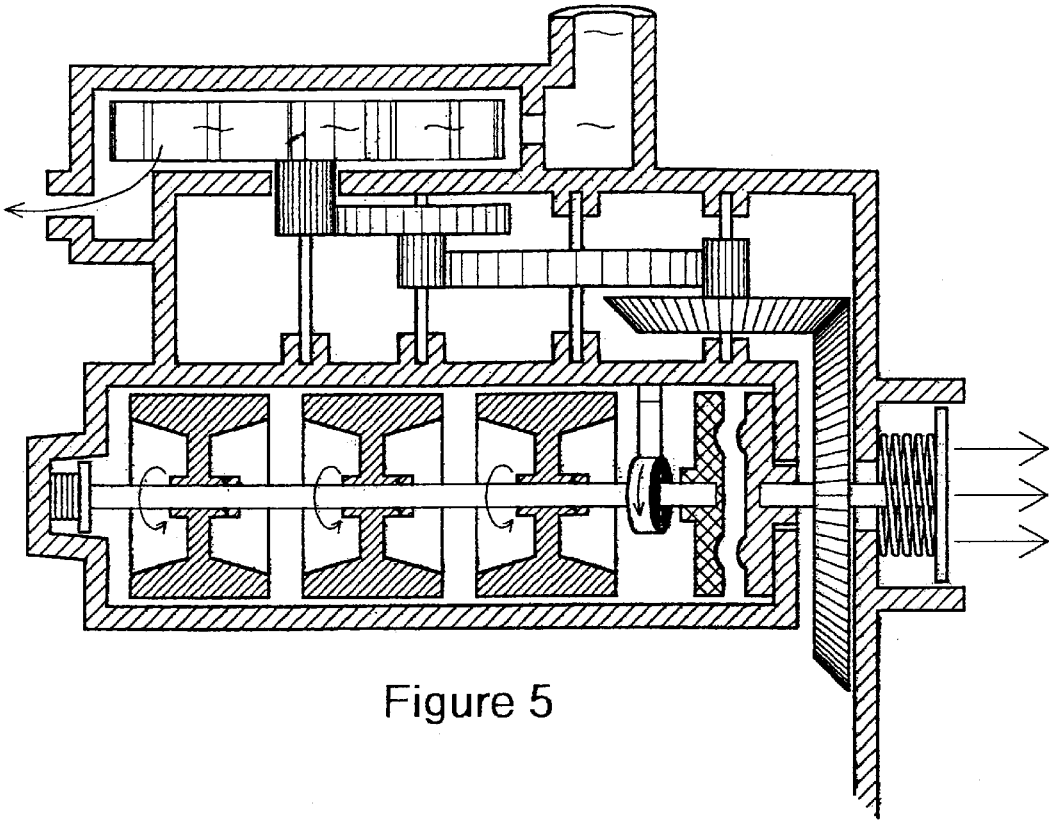

When the water is turned off so that water is no longer forced through the shower unit, the pressure plate 28 is no longer urged to the left and the spring 22 moves the plate 28, together with the shaft 20 and clutch plate 21, to the right. This is shown in FIG. 5. With the dog clutch disengaged, the mechanical energy in the wound spring 17 rapidly accelerates and rotates the shaft 15 as the spring unwinds.

Initially as shown in FIG. 5, the clutches 24, 25 and 26 remain engaged so that the cylinders 12, 13 and 14 are rotated, or spun rapidly, by the shaft 15. After an initial brief period, the clutches 24, 25 and 26 disengage and the cylinders 12, 13 and 14 rotate freely and come to rest. In practice, the configurations or combinations of symbols and numbers visible in the window 11 when the cylinders come to rest are random or unpredictable. This provides an interest or novelty for shower users whenever the shower is turned off after use.

I claim:

1. A sprinkler shower including a game of chance machine and a shower unit, the game of chance machine comprising a plurality of cylinders arranged side by side and rotatable about a common axis, each cylinder having visual displays displaced around a peripheral surface, the shower unit including a window in an exposed surface through which selected portions of the periphery of each cylinder can be viewed, the game of chance machine further including mechanical energy storage means charged by flow of water through the shower unit to produce stored energy, and a mechanical drive mechanism arranged to apply the stored energy to rotate the cylinders so that the cylinders come to rest to provide different combinations of the visual displays in the window during use of the shower.

2. The sprinkler shower according to claim 1, including means to release the stored energy to the cylinders whenever the flow of water through the shower unit ceases.

3. The sprinkler shower according to claim 1, in which the mechanical energy storage means comprises a coil spring wound by the flow of water through the shower unit.

4. The sprinkler shower according to claim 3, including a water impeller wheel and a biassed dog clutch connected between the impeller wheel and the coil spring, including a pressure plate arranged to engage the clutch when water pressure in the shower unit is increased by flow of water through the shower unit.

5. The sprinkler shower according to claim 3, including an axially slidable drive shaft on the common axis, supporting the cylinders, including a separate clutch for connecting each cylinder to the drive shaft and arranged to transfer the stored energy of the coil spring to rotate the cylinders, including biasing means sliding the shaft into a position so that each clutch is normally disengaged, and allowing the stored energy to rotate the cylinders via each separate clutch when the coil spring unwinds.

* * * * *

UNITED STATES PATENT AND TRADEMARK OFFICE

CERTIFICATE OF CORRECTION

PATENT NO. : 6,182,910 B1
DATED : February 6, 2001
INVENTOR(S) : Raico Hing Wah Huen It is certified that error appears in the above-identified patent and that said Letters Patent is hereby corrected as shown below:

Title page,
The title page showing the illustrative figure should be deleted and substitute therefore the attached title page.

Drawings,
Figs. 1-4, should be deleted and substitute therefore the corrected drawing Figs. 1-4, as shown on the attached pages.

(12) United States Patent
Huen

(10) Patent No.: US 6,182,910 B1
(45) Date of Patent: Feb. 6, 2001

(54) SHOWER UNIT

(76) Inventor: Raico Hing Wah Huen, Unit 1-4, 23rd Floor, New Trend Center, 704 Prince Edward Road East, San Po Kong, Kowloon (HK)

( * ) Notice: Under 35 U.S.C. 154(b), the term of this patent shall be extended for 0 days.

(21) Appl. No.: 09/571,931

(22) Filed: May 16, 2000

(51) Int. Cl.[7] ..... B05B 17/00; A63F 9/00
(52) U.S. Cl. ..... 239/289; 263/139; 473/16
(58) Field of Search ..... 239/289; 463/16, 463/17, 22, 30, 31, 46–48; 273/138.1, 139; D21/370

(56) References Cited

U.S. PATENT DOCUMENTS 4,674,687 * 6/1987 Smith et al. ..... 239/525

* cited by examiner

*Primary Examiner*—Lesley D. Morris
(74) *Attorney, Agent, or Firm*—Leydig, Voit & Mayer, Ltd.

(57) ABSTRACT

A sprinkler shower has a game of chance machine mounted in a shower unit to display, at random, different portions of the periphery of rotatable cylinders. The cylinders are driven by a spring that is wound during use of the shower and unwinds, to rotate the cylinders, when water flowing through the shower unit is turned of.

5 Claims, 4 Drawing Sheets

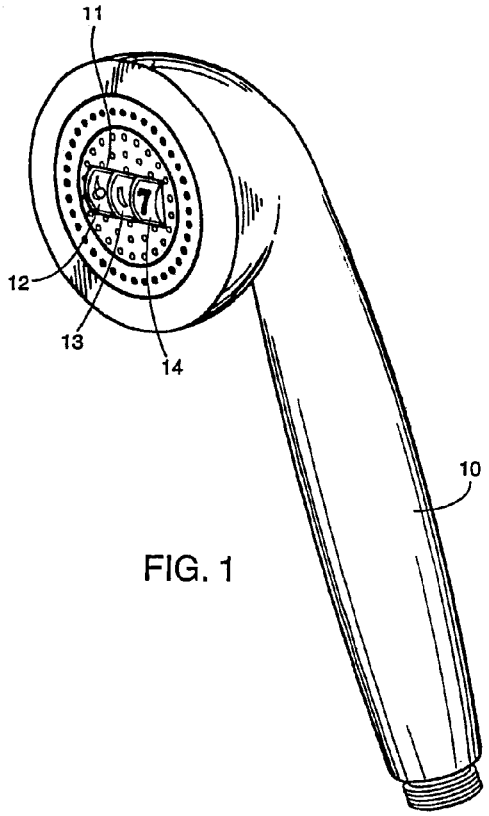

FIG. 1

UNITED STATES PATENT AND TRADEMARK OFFICE

CERTIFICATE OF CORRECTION

PATENT NO. : 6,182,910 B1
DATED : February 6, 2001
INVENTOR(S) : Raico Hing Wah Huen It is certified that error appears in the above-identified patent and that said Letters Patent is hereby corrected as shown below:

Substitute the following for Figure 1

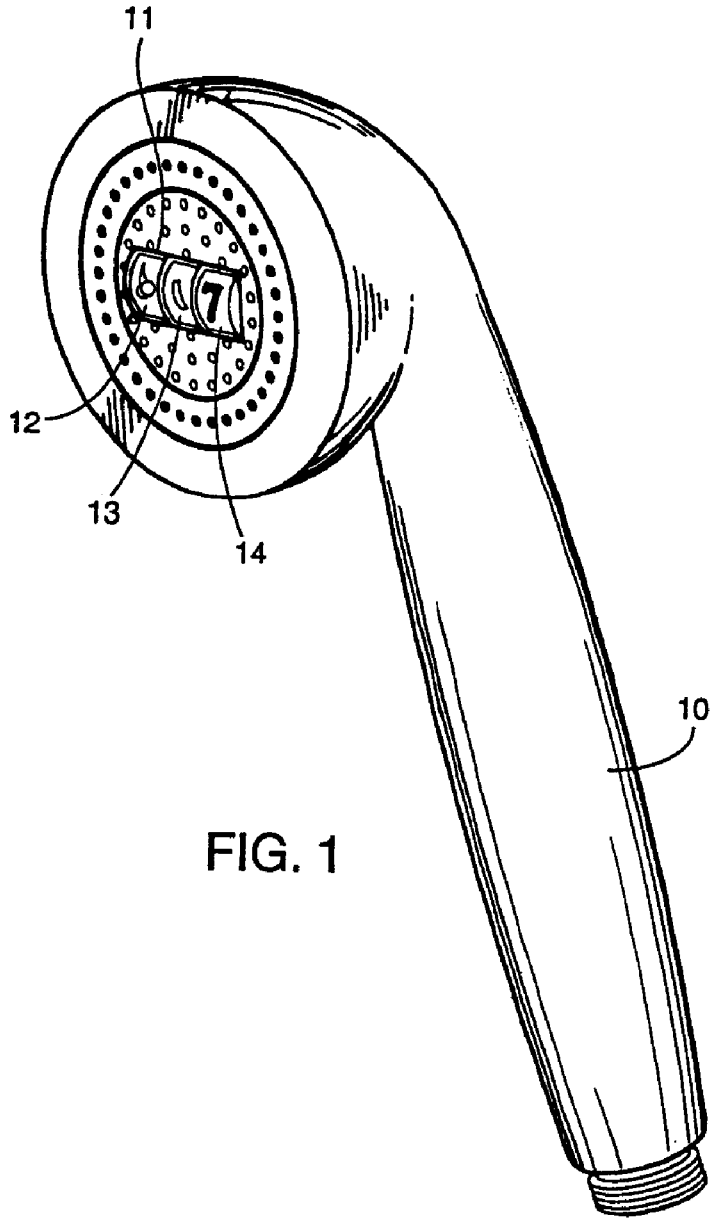

FIG. 1

UNITED STATES PATENT AND TRADEMARK OFFICE

CERTIFICATE OF CORRECTION

PATENT NO. : 6,182,910 B1 
DATED : February 6, 2001
INVENTOR(S) : Raico Hing Wah Huen It is certified that error appears in the above-identified patent and that said Letters Patent is hereby corrected as shown below:

Substitute the following for Figure 2

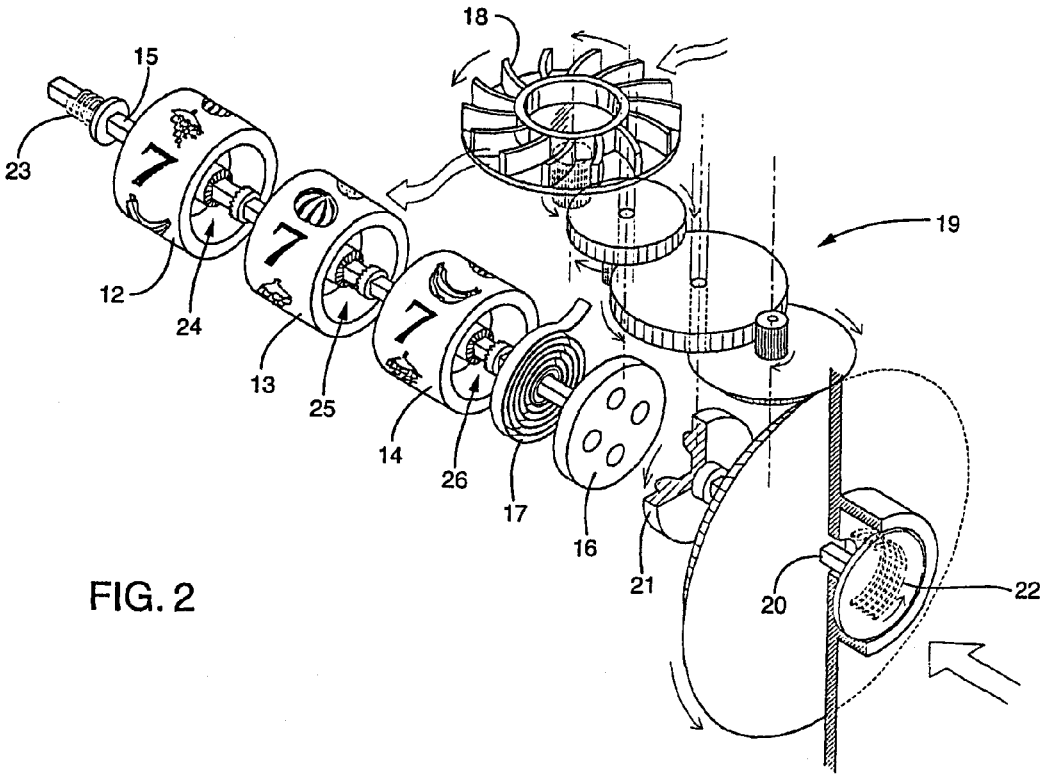

FIG. 2

UNITED STATES PATENT AND TRADEMARK OFFICE

CERTIFICATE OF CORRECTION

PATENT NO. : 6,182,910 B1
DATED : February 6, 2001
INVENTOR(S) : Raico Hing Wah Huen It is certified that error appears in the above-identified patent and that said Letters Patent is hereby corrected as shown below:

Substitute the following for Figures 3 and 4.

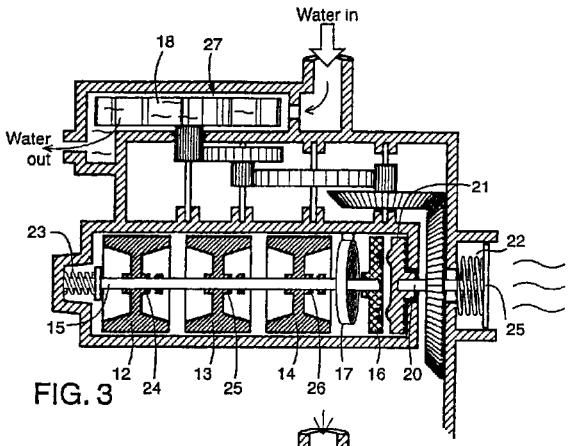

FIG. 3

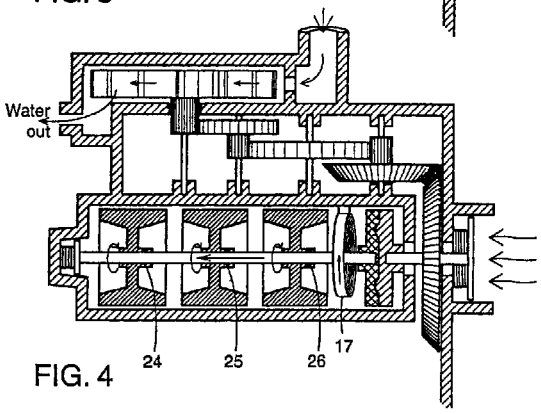

FIG. 4

Signed and Sealed this

Thirtieth Day of July, 2002

*Attest:*

*Attesting Officer*

JAMES E. ROGAN
*Director of the United States Patent and Trademark Office*